US006779782B1

(12) United States Patent
Webb

(10) Patent No.: US 6,779,782 B1
(45) Date of Patent: Aug. 24, 2004

(54) CORNERPOST AND H-BRACE SYSTEM

(76) Inventor: Russell L. Webb, Rte. 1, Box 830, Webbers Falls, OK (US) 74470

( * ) Notice: Subject to any disclaimer, the term of this patent is extended or adjusted under 35 U.S.C. 154(b) by 0 days.

(21) Appl. No.: 10/352,573

(22) Filed: Jan. 28, 2003

(51) Int. Cl.[7] ..... E04H 17/14

(52) U.S. Cl. ..... 256/63.03; 256/65.01; 256/67

(58) Field of Search ..... 256/24, 26–31, 256/65.02–65.08, 65.12, 65.13, 65.16, 59, 60, 65.01, 66–68

(56) References Cited

U.S. PATENT DOCUMENTS

| | | | | | |
|---|---|---|---|---|---|
| 859,239 | A | * | 7/1907 | McFall | 256/57 |
| 2,715,513 | A | * | 8/1955 | Kools | 256/21 |
| 2,835,475 | A | * | 5/1958 | Enghauser | 256/22 |
| 4,616,950 | A | * | 10/1986 | Morris | 256/65.07 |
| 4,923,176 | A | | 5/1990 | Heinz | |
| 4,951,925 | A | * | 8/1990 | Schultz et al. | 256/65.06 |
| 5,026,028 | A | * | 6/1991 | Ooi et al. | 256/67 |
| 5,215,290 | A | * | 6/1993 | Khalessi | 256/19 |
| 5,238,321 | A | * | 8/1993 | Jarjoura | 256/65.14 |
| 5,547,169 | A | | 8/1996 | Russell | |
| 5,593,143 | A | | 1/1997 | Ferrarin | |
| 5,645,271 | A | | 7/1997 | Nunez | |
| 5,695,174 | A | * | 12/1997 | Tsai | 256/22 |
| 5,938,184 | A | * | 8/1999 | DeSouza | 256/19 |
| 6,029,954 | A | * | 2/2000 | Murdaca | 256/59 |
| 6,053,481 | A | | 4/2000 | Scheide | |
| 6,406,003 | B1 | | 6/2002 | Shaw | |
| 6,557,831 | B2 | * | 5/2003 | Erwin | 256/65.04 |
| 6,648,304 | B1 | * | 11/2003 | Zhu | 256/22 |
| 2002/0027223 | A1 | | 3/2002 | Doyle, Jr. | |
| 2002/0121635 | A1 | | 9/2002 | Erwin | |
| 2003/0030048 | A1 | * | 2/2003 | Quaintance et al. | |

* cited by examiner

*Primary Examiner*—Robert J. Sandy
*Assistant Examiner*—Ruth C. Rodriguez
(74) *Attorney, Agent, or Firm*—Molly D. McKay

(57) ABSTRACT

A corner post and H-brace system for building fences employing standard components of the system and a couple of simple tools. The system employs fence posts and connecting rods that extend between adjacent fence posts. The connecting rods attach to ears and rings provided on the posts via bolts or other suitable fasteners. The ears and rings allow the connecting rods to be pivoted upward and downward relative to the posts and allow the connecting rods to be rotated around the posts so that a fence of any horizontal curvature can be custom built, even on ground that is not level.

4 Claims, 5 Drawing Sheets

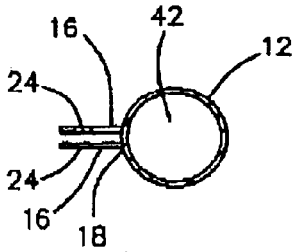
Fig. 14
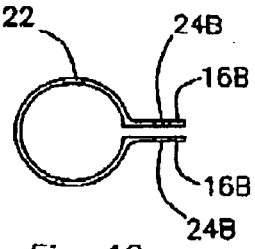
Fig. 12
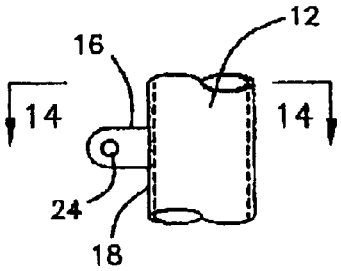
Fig. 13
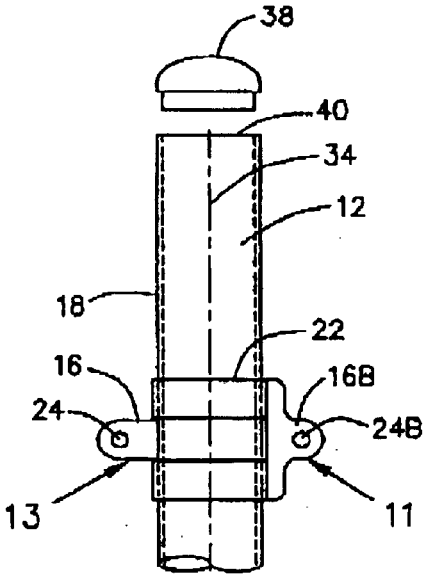
Fig. 10
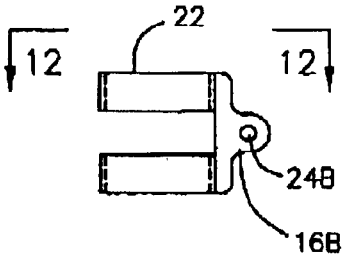
Fig. 11
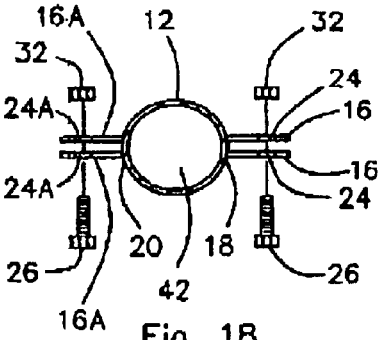
Fig. 18
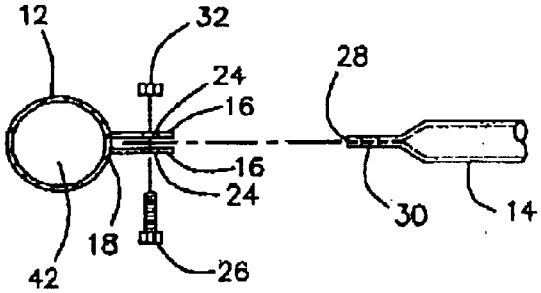
Fig. 16
Fig. 20
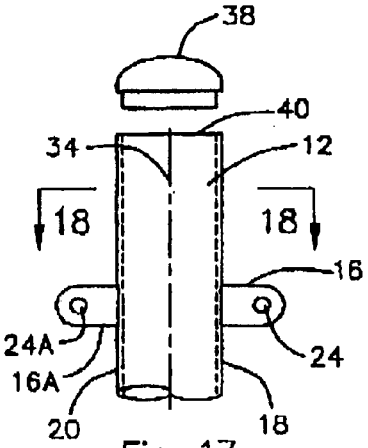
Fig. 17
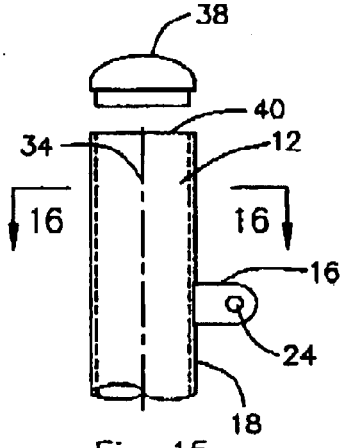
Fig. 15
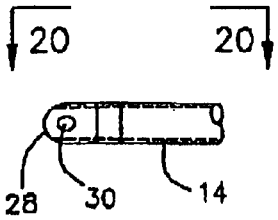
Fig. 19

CORNERPOST AND H-BRACE SYSTEM

BACKGROUND OF THE INVENTION

1. Field of the Invention

The present invention relates to a corner post and H-brace system for building fences. More specifically, the present invention is a system employing fence posts and connecting rods that extend between adjacent fence posts. The connecting rods attach to the posts via ears and rings provided on the posts. The connecting rods and the ears and rings which are standard structural components of the system allow a fence of any horizontal curvature to be custom built, even when the ground on which the fence is to be built that is not level.

2. Description of the Related Art

Building fences for containing livestock is a task that the stockman must routinely perform. Unfortunately, these fences must be built on relatively inaccessible and hilly terrain. Also, the fences often must be built to curve around obstacles, such as ponds or streams. Finally, the corners of the fences are often not perpendicular. Traditionally, when fences are built under these conditions, the workman must custom make the corner posts and bracing for the corner posts and must custom make H-braces for the fence. This customization requires a great deal of time and requires the workman to carry extra tools and materials to the construction site, increasing the time, trouble and cost of the construction.

The present invention relates to a corner post and H-brace system for building fences that addresses these problems. More specifically, the present invention is a system employing fence posts and connecting rods that extend between adjacent fence posts. The connecting rods attach to the posts via ears and rings provided on the posts. The connecting rods and the ears and rings, which are standard structural components of the system, allow a fence of any horizontal curvature to be custom built, even when the ground on which the fence is to be built that is not level. Construction of fences, corner posts, and H-braces employing the present invention requires only those tools that are necessary to set the posts and additionally only a couple of tools for securing the connecting rods to the fence posts via bolts or via other suitable fasteners.

SUMMARY OF THE INVENTION

The present invention is a corner post and H-brace system for building fences. The present invention is a system employing fence posts and connecting rods that extend between adjacent fence posts. The connecting rods attach to the posts via ears and rings provided on the posts. Each fence post is provided with at least two sets of ears provided on one side of the post. Each set of ears is provided with aligned bolt openings there through for receiving a bolt or other similar type of fastener. Each end of the connecting rods is similarly provided with a bolt opening.

The connecting rods secure to the pairs of ears on adjacent fence posts by inserting the end on the connecting rod between a pair of ears so that all of the bolt openings in the connecting rod and the pair of ears align, and then securing a bolt or other fastening device through the aligned bolt openings. The pairs of ears are aligned with a longitudinal axis of their associated fence posts so that the connecting rod can pivot upward and downward, i.e. pivot so that the oppose end of the connecting rod can move vertically, at the pair of ears relative to the fence post.

Each fence post may alternately be provided with additional opposite sets of ears on a second opposite side of the post or with rings that secure around the original sets of ears provided on the first side of the post. Each ring is rotatable horizontally on its associated post so that the connecting rods that attach to a pair of ring ears provided on each ring can be rotated horizontally relative to its associated fence post.

Thus, the three types of fence posts employed in the present system are fence posts having pairs of ears on only a first side of the posts, fence posts having pairs of ears on two opposite sides of the posts, and fence posts with a combination of a ring associated with each of pair of ears where the pairs of ears are located on only the first side of the posts. These three types of fence posts, along with connecting rods and fasteners comprise the standard components of the present system. Any one of the three types of fence posts or any combination of the three types can be used together with the connecting rods and fasteners to construct a fence, a corner post, an H-brace, or any other type of fence configuration desired.

The connecting rods and the ears and rings, which are standard structural components of the system, allow a fence of any horizontal curvature to be custom built, even when the ground on which the fence is to be built that is not level. Construction of fences, corner posts, and H-braces employing the present invention requires only those tools that are necessary to set the posts and additionally only a couple of tools for securing the connecting rods to the fence posts via bolts or via other suitable fasteners.

BRIEF DESCRIPTION OF THE DRAWINGS

FIG. 10 is an enlarged front view of a fence post with a combination pair of ears on one side of the post and a ring encircling the pair of ears.

FIG. 11 is the ring of FIG. 10, as indicated by arrow 11 in FIG. 10, shown removed from the post.

FIG. 12 is a top view taken along line 12—12 of FIG. 11.

FIG. 13 is an enlarged view of the post and attached pair of ears of FIG. 10, as indicated by arrow 13 in FIG. 10.

FIG. 14 is a cross sectional view taken along line 14—14 of FIG. 13.

FIG. 15 is an enlarged front view of a fence post with attached pair of ears on one side of the post.

FIG. 16 is a cross sectional view taken along line 16—16 of FIG. 15.

FIG. 17 is an enlarged front view of a fence post with pairs of ears attached on opposite sides of the post.

FIG. 18 is a cross sectional view taken along line 18—18 of FIG. 17 with bolts and nuts shown in relationship to the bolt openings provided in the pairs of ears.

FIG. 19 is an enlarged front view of an end of a connecting rod showing the bolt opening there through.

FIG. 20 is a top view of the connecting rod taken along line 20—20 of FIG. 19.

DETAILED DESCRIPTION OF THE PREFERRED EMBODIMENT

The Invention

Figure 1:
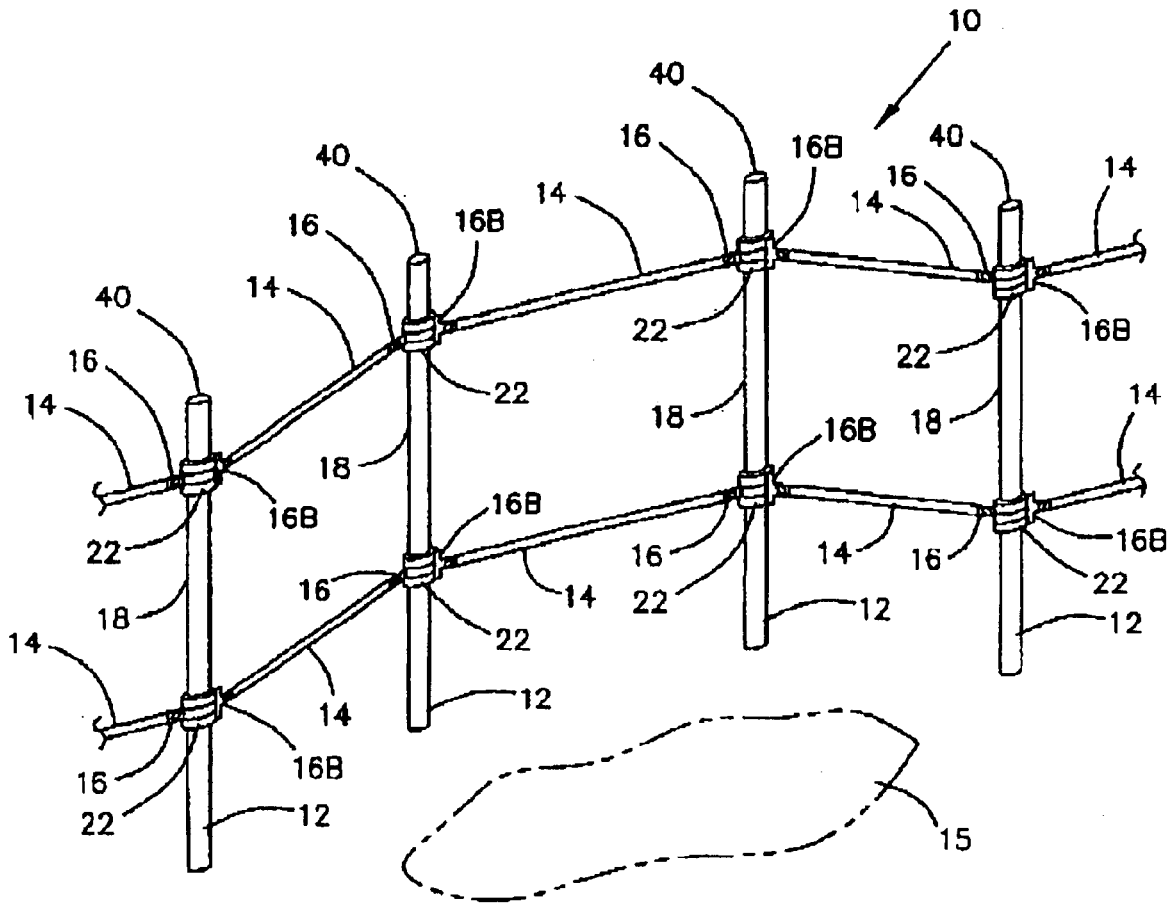
FIG. 1 is a perspective view of a curved fence built around an obstruction employing a corner post and H-brace system for building fences according to a preferred embodiment of the present invention.

Referring now to the drawings and initially to FIGS. 1–9 and 21, there is illustrated a corner post and H-brace system 10 for building fences according to a preferred embodiment of the present invention. The present invention is a system 10 employing three configurations of fence posts 12, connecting rods 14 that extend between adjacent fence posts 12, and fasteners for securing the connecting rods 14 to the posts 12.

Figure 2:
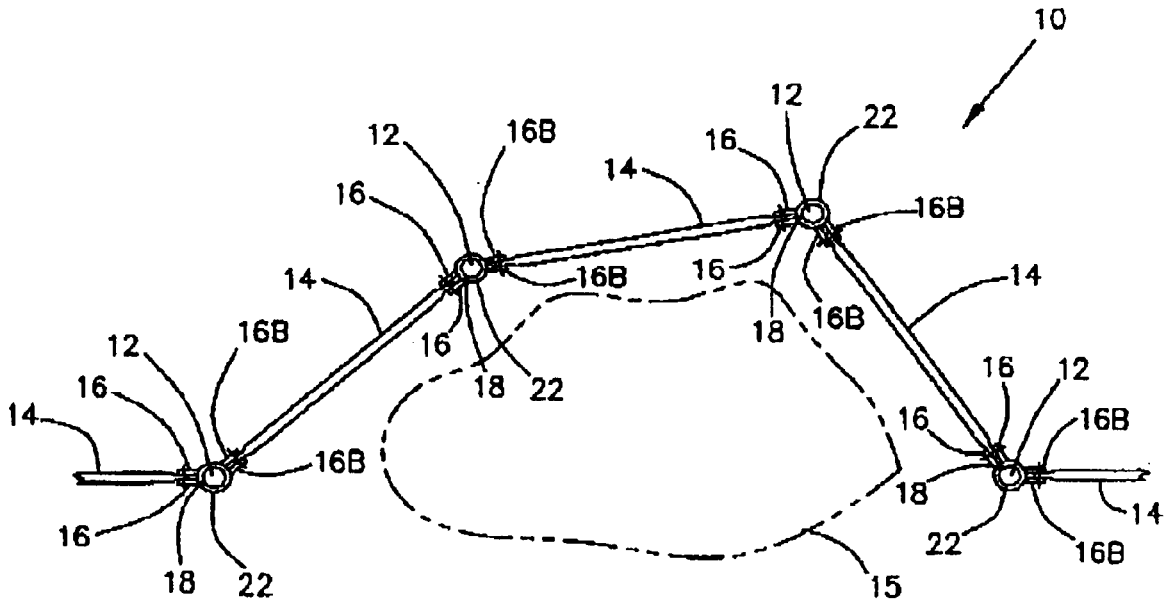
FIG. 2 is a top view of the fence of FIG. 1.
Figure 3:
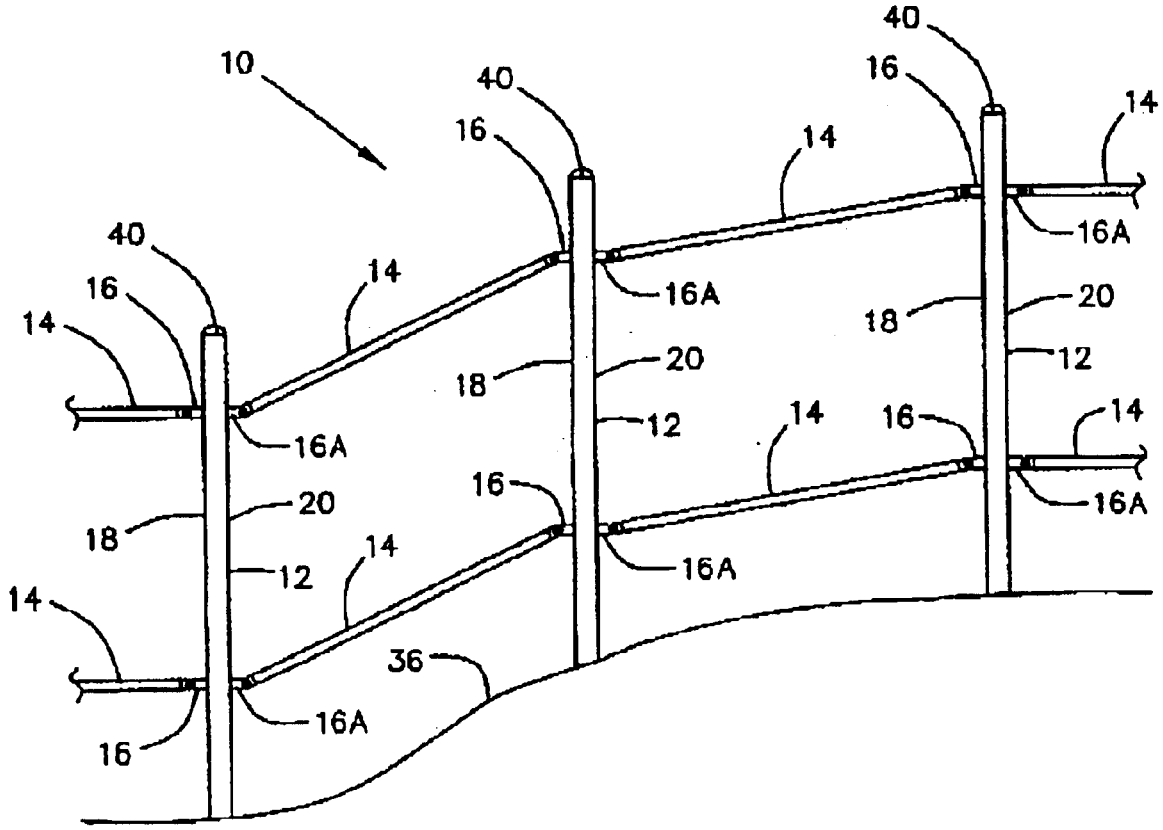
FIG. 3 is a front view of a second straight fence built on uneven ground employing the system of the present invention.
Figure 4:
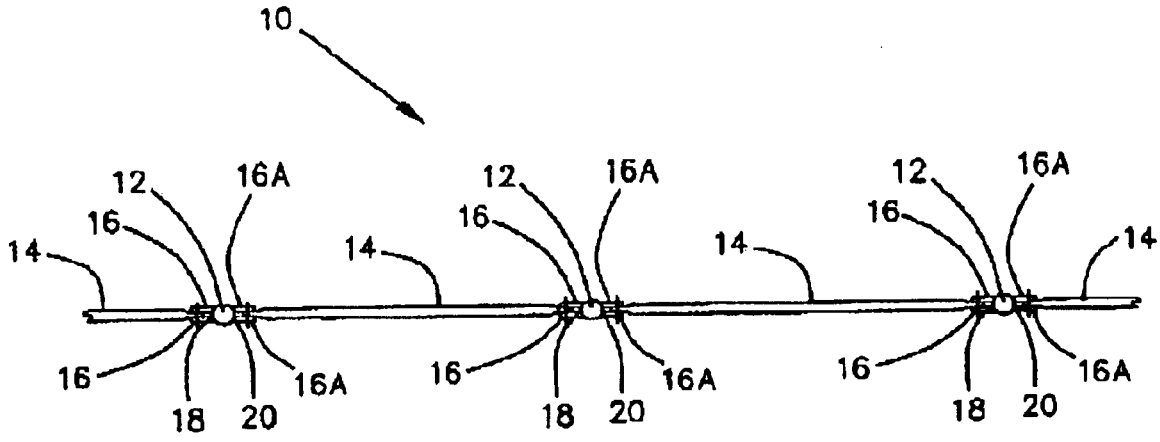
FIG. 4 is a top view of the fence of FIG. 3.
Figure 5:
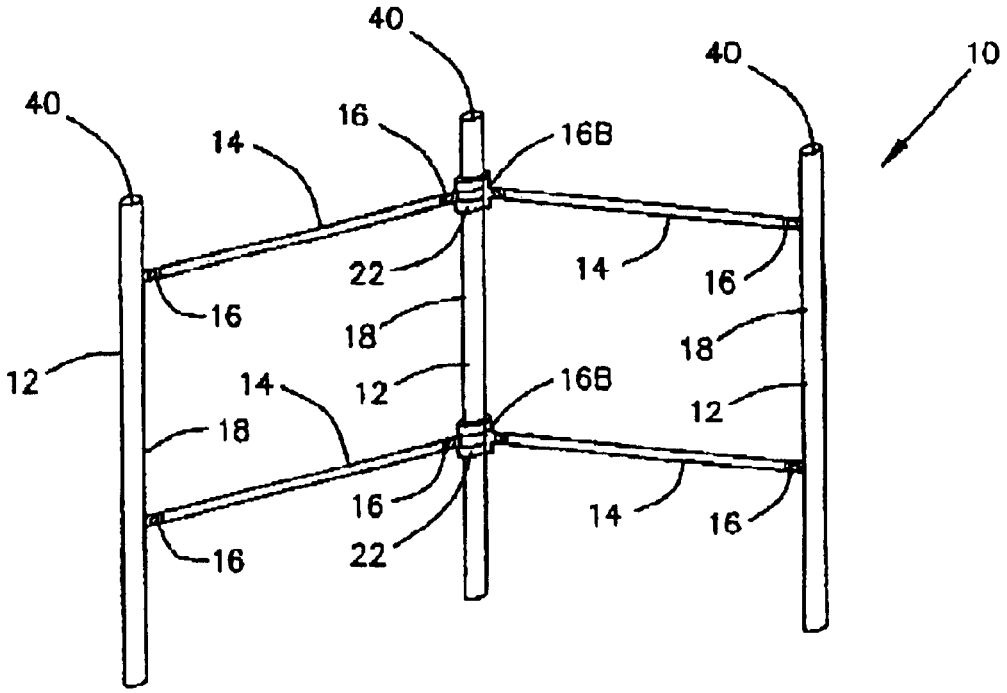
FIG. 5 is a corner post built employing the system of the present invention.
Figure 6:
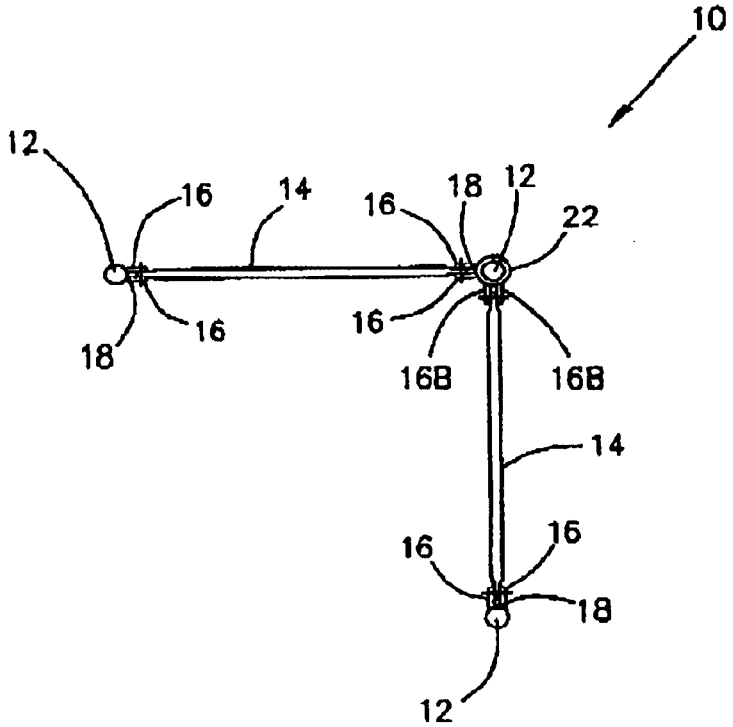
FIG. 6 is a top view of the corner post of FIG. 5.
Figure 7:
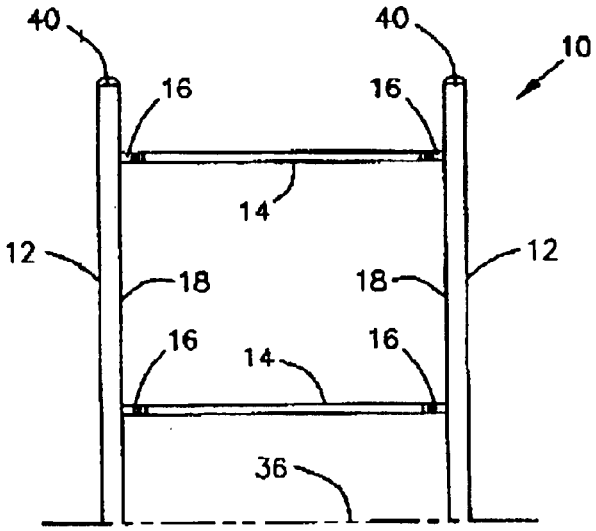
FIG. 7 is an H-brace built employing the system of the present invention.
Figure 21:
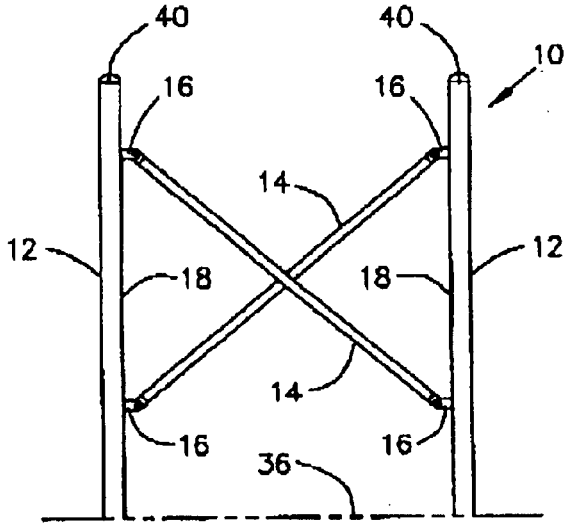
FIG. 21 is an X-brace built employing the system of the present invention.
Figure 8:
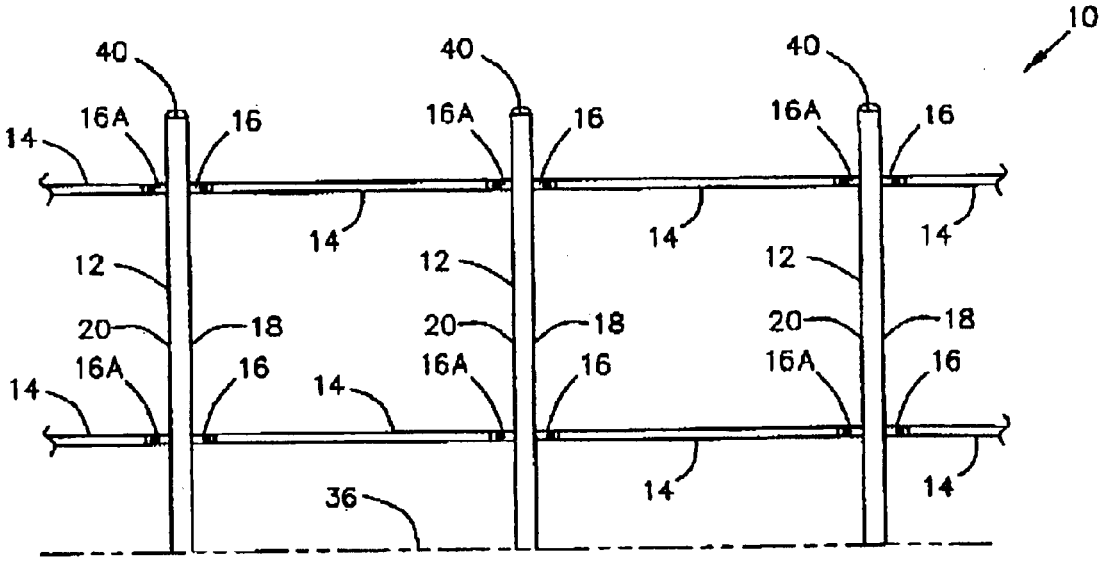
FIG. 8 is a straight fence built on level ground employing the system of the present invention.
Figure 9:
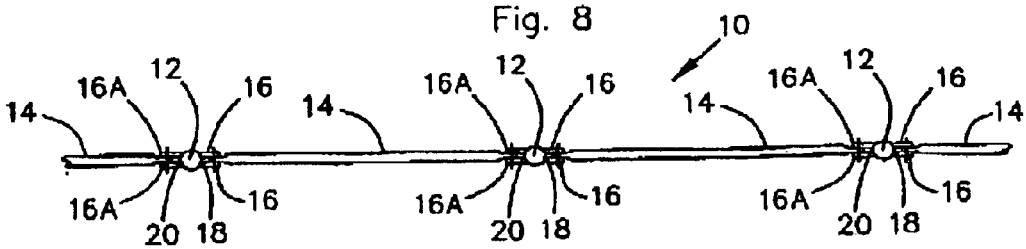
FIG. 9 is a top view of the fence of FIG. 8.

FIGS. 1 and 2 illustrate a curved fence that may be built with the system 10 either on level or uneven ground 36 in order to avoid an obstacle 15 such as the one shown in outline in FIGS. 1 and 2. FIGS. 3, 4, 8 and 9 illustrate a straight fence built with the system 10 either on level or uneven ground 36. FIGS. 5 and 6 illustrate a corner post arrangement built with the system 10 either on level or uneven ground 36. FIG. 7 illustrates an H-brace arrangement built with the system 10 either on level or uneven ground 36. FIG. 21 illustrates an X-brace arrangement which can be built with the system 10 only on level ground 36.

Also referring to FIGS. 10–20, the connecting rods 14 attach to the posts 12 via pairs of ears 16 and pairs of opposite ears 16A provided, respectively, on first and second sides 18 and 20 of the posts 12, and via pairs of ring ears 16B provide on rings 22 that rotatably attach to the posts 12 in association with the pairs of ears 16 that are attached on the first side 18 of the posts 12.

FIG. 11 illustrates the ring of FIG. 10, as indicated by arrow 11 in FIG. 10, and FIG. 13 illustrates the post and attached pair of ears of FIG. 10, as indicated by arrow 13 in FIG. 10.

Each of the three types or configurations of fence posts 12 employed in the present system 10 is provided with at least two sets of ears 16 provided on the first side 18 of the post 12. Each set of ears 16 is provided with aligned bolt openings 24 there through for receiving a bolt 26 or other similar type of fastener. Each end 28 of the connecting rods 14 is similarly provided with a bolt opening 30.

As best illustrated in FIGS. 15, 16, 19, and 20, the connecting rods 14 secure to the pairs of ears 16 on adjacent fence posts 12 by inserting the end 28 of the connecting rod 14 between a pair of ears 16 so that the bolt openings 24 and 30 in the pair of ears 16 and in the end 28 of the connecting rod 14 align, and then securing a bolt 26 or other fastening device through the aligned bolt openings 24 and 30. If a bolt 26 is employed, it is secured within the bolt openings 24 and 30 via a nut 32.

Referring now also to FIGS. 15 and 16, the pairs of ears 16 are aligned with a longitudinal axis 34 of their associated fence post 12 so that the connecting rod 14 can pivot upward and downward, i.e. pivot so that the oppose end 28 of the connecting rod 14 can move vertically, at the pair of ears 16 relative to the fence post 12.

As illustrated in FIGS. 17 and 18, each fence post 12 may be provided with additional opposite sets or pairs of ears 16A on the second opposite second side 20 of the post 12 or, alternately as illustrated in FIGS. 10–14, may be provided with rings 22 that secure around the original sets of ears 16 provided on the first side 18 of the post 12. Each ring 22 is provided with a pair of ring ears 16B, and each of the pairs of ears 16A and 16B is provided with aligned bolt openings 24A and 24B, respectively, there through similar to the bolt openings 24 previously described in relationship to the ears 16. Each ring 22 is rotatable horizontally on its associated post 12 so that the connecting rods 14 that attach to the pair of ring ears 16B via the bolt openings 24B can be rotated horizontally relative to its associated fence post 12.

Referring now also to FIGS. 17 and 10, the pairs of ears 16A, and 16B are aligned with the longitudinal axis 34 of their associated fence posts 12 so that the connecting rod 14 can pivot upward and downward, i.e. pivot so that the oppose end 28 of the connecting rod 14 can also move vertically, at the pairs of ears 16A and 16B relative to the fence post 12.

Thus, the three types of fence posts 12 employed in the present system are fence posts 12 having pairs of ears 16 on only a first side 18 of the posts 12; fence posts 12 having pairs of ears 16 and 16B on two opposite sides 18 and 20, respectively, of the posts 12; and fence posts 12 with a combination of a ring 22 associated with each pair of ears 16 where the pairs of ears 16 are located on only the first side 18 of the posts 12. These three types of fence posts 12, along with connecting rods 14 and fasteners 26 and 32 comprise the standard components of the present system 10. Any one of the three types of fence posts 12 or any combination of the two or more or the three types can be used together with the connecting rods 14 and fasteners 26 and 32 to construct a fence, a corner post, an H-brace, and X-brace or any other type of fence configuration desired.

The connecting rods 14 and the ears 16, 16A, and 16B and rings 22, which are standard structural components of the system 10, allow a fence of any horizontal curvature to be custom built, even when the ground 36 on which the fence is to be built that is not level. Construction of fences, corner posts, H-braces, X-braces, etc. employing the present invention requires only those tools that are necessary to set the posts 12 and additionally only a couple of tools for securing the connecting rods 14 to the fence posts 12 via bolts 26 and nuts 32 or via other suitable fasteners.

As illustrated in FIGS. 10, 15, 16, 17, and 18 although not required, decorative caps 38 may optionally be attached to the tops 40 of the posts 12 to prevent water from entering the hollow interior cavities 42 of the posts 12.

While the invention has been described with a certain degree of particularity, it is manifest that many changes may be made in the details of construction and the arrangement of components without departing from the spirit and scope of this disclosure. It is understood that the invention is not limited to the embodiments set forth herein for the purposes of exemplification, but is to be limited only by the scope of the attached claim or claims, including the full range of equivalency to which each element thereof is entitled.

What is claimed is:

1. A corner post and H-brace system for building fence comprising:

at least two fence posts, each said post provided with at least two pairs of ears located on a first side of the post, connecting rods, each connecting rod provided with an end for attachment to a pair of ears provided on the posts, each end of a connecting rod attached to an adjacent fence posts via one of the pairs of ears provided on the posts so that each connecting rod extends between to adjacent fence posts, each pair of ears provided with a bolt opening there through for removably receiving a fastener, each end of the connection rods provided with a bolt opening there through for removably receiving a fastener, a fastener extending through the bolt openings of one end of each connecting rod and a pair of ears on the fence posts to removably secure the connecting rods between adjacent fence posts, each pair of ears aligned vertically with the longitudinal axis of its associated fence post so that its associated rod can pivot upward and downward at the pair of ears, one or more of said fence posts provided with a ring that encircles one of the pairs of ears provided on the first side of the fence posts, each said ring rotatable horizontally relative to its associated fence post, each ring provided with a pair of ring ears, each pair of ring ears provided with a bolt opening there through for removably receiving a fastener, a fastener extending through the bolt openings of one end of said connecting rods and an opposite pair of ring ears on the fence posts to removably secure the connecting rods between adjacent fence posts, and each opposite pair of ring ears aligned vertically with the longitudinal axis of its associated fence post so that its associated rod can pivot upward and downward at the ring ears.

2. A corner post and H-brace system for building fence comprising:

at least two fence posts, each said post provided with at least two pairs of ears located on a first side of the post, connecting rods, each connecting rod provided with an end for attachment to a pair of ears provided on the posts, each end of a connecting rod attached to an adjacent fence posts via one of the pairs of ears provided on the posts so that each connecting rod extends between two adjacent fence post, one or more of said fence posts provided with a ring that encircles one of the pairs of ears provided on the first side of the fence posts, each said ring rotatable horizontally relative to its associated fence post, each ring provided with a pair of ring ears, each pair of ring ears provided with a bolt opening there through for removably receiving a fastener, a fastener extending through the bolt openings of one end of said connecting rods and an opposite pair of ring ears on the fence posts to removably secure the connecting rods between adjacent fence posts, and each opposite pair of ring ears aligned vertically with the longitudinal axis of its associated fence post so that its associated rod can pivot upward and downward at the ring ears.

3. A corner post and H-brace system for building fence comprising:

two or most fence posts, each said fence post provided with at least two pair of ears on a first side of the post, connecting rods attached on their ends to pairs of ears on the posts so that the connecting rods extend between adjacent fence posts and pivot at the ears upward and downward relative to the posts, at least one fence post provided with a ring secured around each pair of ears, each said ring rotatable horizontally relative to its associated fence post, each ring provided with a pair of ring ears, and each pair of ring ears provided with a bolt opening for removable attachment to an end of a connecting rod in order to connect adjacent fence posts together via the connecting rods.

4. A corner post and H-brace system according to claim 3 further comprising:

at least two opposite pair of ears provided on an opposite second side of at least one fence post, each opposite pair of ears provided with a bolt opening for removable attachment to an end of a connecting rod, and connecting rods attached on their ends to opposite pairs of ears on the post so that the connecting rods extend between adjacent fence posts and pivot at the opposite pairs of ears upward and downward relative to the post.

* * * * *